US006041750A

United States Patent [19]

Miller

[11] Patent Number: 6,041,750

[45] Date of Patent: Mar. 28, 2000

[54] ROCKER ARM BRIDGE FOR INTERNAL COMBUSTION ENGINES

[76] Inventor: James Miller, 1791 Blount Rd., Suite 501, Pompano Beach, Fla. 33069

[21] Appl. No.: 09/249,742

[22] Filed: Feb. 11, 1999

Related U.S. Application Data

[60] Continuation of application No. 08/789,508, Jan. 27, 1997, which is a division of application No. 08/514,070, Aug. 11, 1995, Pat. No. 5,596,958.

[51] Int. Cl.[7] ..... F01L 1/18; F02F 1/24

[52] U.S. Cl. ..... 123/193.5; 123/90.39; 29/888.011; 29/888.06

[58] Field of Search ..... 123/90.22, 90.23, 123/90.27, 90.39, 90.41, 90.44, 90.61, 193.3, 193.5; 29/888.01, 888.011, 888.06

[56] References Cited

U.S. PATENT DOCUMENTS

| | | | |
|---|---|---|---|
| 2,780,871 | 2/1957 | Campbell | 33/611 |
| 2,835,044 | 5/1958 | Haunert | 33/611 |
| 3,501,843 | 3/1970 | Bandimere | 33/611 |
| 3,686,768 | 8/1972 | Humpbert | 33/611 |
| 3,821,942 | 7/1974 | Ishida | 123/90.38 |
| 4,488,520 | 12/1984 | Almor | 123/90.39 |
| 4,724,805 | 2/1988 | Wirth et al. | 123/90.39 |
| 4,748,946 | 6/1988 | Fujii | 123/90.44 |
| 5,005,544 | 4/1991 | Spangler | 123/195 R |
| 5,027,761 | 7/1991 | Fujii | 123/90.23 |
| 5,095,861 | 3/1992 | Dove | 123/90.39 |
| 5,213,071 | 5/1993 | Iwata | 123/90.27 |
| 5,241,928 | 9/1993 | Hamada et al. | 123/90.23 |
| 5,339,778 | 8/1994 | Reckzugel et al. | 123/193.5 |
| 5,458,099 | 10/1995 | Koller et al. | 123/193.5 |

*Primary Examiner*—Weilun Lo

[57] ABSTRACT

The instant invention is a rocker arm bridge support system for high performance engines. The bridge support system eliminates the compound geometry angular placement of valves with a rigid support structure using a common or segmented shaft for securing angular disposed rocker arms to accommodate the offset geometry. A bridge top secures the rocker arm shaft in a free floating manner by bolting of the bridge base directly to the cylinder head as well as the bridge top which is also bolted to the cylinder head by use of through apertures located in the bridge base. The invention includes the teaching of offset rocker arms mountable to the rocker arm shaft to accommodate the angular valve placement.

7 Claims, 5 Drawing Sheets

ROCKER ARM BRIDGE FOR INTERNAL COMBUSTION ENGINES

This is a Continuation of application Ser. No. 08/789,508, filed Jan. 27, 1997, which is a Divisional of application Ser. No. 08/514,070, filed Aug. 11, 1995, now U.S. Pat. No. 5,596,958, issued Jan. 28, 1997.

FIELD OF THE INVENTION

The instant invention is related to internal combustion engines and, more particularly, to an improved overhead valve stabilization system for rocker arms.

BACKGROUND OF THE INVENTION

Internal combustion engines are used as the primary power plant for modern day vehicles. The engines rely upon the expansion of gases within cylinder heads wherein pistons, connecting rods, and a crank shaft convert a controlled explosion in a cylinder chamber into rotational movement. Control of the cylinder chamber is performed by sequential operation of intake and exhaust valves operated in conjunction with an overhead valve design incorporating a camshaft, cam follower, push rod, and rocker arm for conducting air flow into and out of the cylinder chambers. The stress on these components is dramatically increased in those instances where the valve train must perform at higher than normal engine speeds such as those associated with high performance vehicles.

Specialty rocker arms and valve train assemblies capable of withstanding high stress are typically modified from mass produced internal combustion engines. Over the years many aberrations were developed around original equipment manufactured by the Ford Motor Company, General Motors, and the Chrysler Corporation. As these valve train components evolved, two factions of product groups within the after market industry also evolved as separate entities which focus mainly on their independent forte in developing of components related to the valve train. Both depend upon each other for compatibility in providing optimum performance. The valves are contained within the cylinder head, the rocker arm portion is mounted upon the cylinder head and operatively associated with the valves. The rocker arm and the valve train design criteria is influenced by the parameters established in the cylinder head design: often appearing as though each manufacturing entity is unaware or oblivious to the others' needs.

Rocker arms transfer the operational timing of a precision designed and manufactured component, the camshaft, and further increase the cam's instructions of movement by means of a mechanical increase in ratio, usually between 1.5:1 and 2.0:1, requiring utmost precision in operation to obtain maximum efficiency. The problem is that rocker arms inherently suffer from wear and fatigue imposed through the variables of heat and flex: a foremost element of operation which amplifies and accelerates these consequences. While in-line valves and in-line rocker arm shafts are traditional designs within the industry, staggered valves or valves sitting at compound angles have forced the current art of this technology to adapt independent rocker arm designs. These designs provide for a compound angle rocker arm mounting which has been addressed as only a single rocker arm mounted upon a single shaft placed at the appropriate compound angle to maintain an even contact with the valve stem lip throughout the valve's travel, sacrificing the rigidity. Many cylinder heads now employ compound angle valves placing the associated rocker arms at compound angles to facilitate proper alignment with the valve's centerline during valve lifter operation.

Roller tip rocker arms for automobile applications, initially made of aluminum, are traceable to the late 1950's, with a series of different companies over the years giving birth to a variety of different designs, materials and applications; none of which has established a science of design which is precedent setting to all applications; although it was from this arena that the current "technology" of rocker arms arose. Today, these components are deemed an asset in relieving or minimizing friction with the engine's valve train for all types of vehicle applications. When rocker arms use a roller that is radiated on its outside diameter to provide a pivoting axis that is not in alignment with the valve's centerline of motion, or on cylinder heads which, for whatever reason, have in-line rocker arm shafts that allow the rocker arm to pivot parallel to the camshaft and perpendicular to the valve's linear travel, this can provide increased rigidity and a more simple stand design to further that rigidity.

Thus, a primary problem with the prior art rocker arm stand is directed to the various heights and angles used to accommodate placement of the intake and exhaust valves in conjunction with the push rods operated by a camshaft. While the offset geometry allowed for more fluent operation of the valves and push rods, the rocker arm stands have to be placed at different elevations and angled to accommodate the valve and push rod. For this reason, a situation occurs in maintaining rigidity to the rocker arm movement which can alter performance of the vehicle and is most notable in high performance engines.

One method used by high performance fabricators for lessening the movement of the rocker arm components is by welding the rocker arm stands together. Despite the benefit of increased rigidity, welding is permanent, lessening the ability for rocker arm change-out. In addition, welding tempers the steels which may lead to a faulty component during a high stress situation.

Another method of increasing the rigidity of rocker arm stands is the use of a rod like structure which bolts a plurality of studs together, commonly known as a stud girdle. The stud girdle simply couples the upper portion of mounting studs and does not address the cause for lack of rigidity. Further, stud girdles are complicated structures when used in combination with compound geometry cylinder heads.

Thus, what is lacking in the art is a method and apparatus for eliminating the compound angles used in accommodating the angular valve placement to provide the benefits of offset valve arrangement with an ability to stabilize rocker arm placement thereby.

SUMMARY OF THE INVENTION

The instant invention is a method an apparatus for removal of compound geometry rocker arms for maintaining a rocker arm structure in a fixed position. The result is a commonly shared rocker arm shaft, or shafts that are in a parallel plane with the camshaft allowing the use of offset rocker arms to accommodate offset valves.

The instant invention sets forth a first embodiment which teaches the use of two or more rocker arms of differing lengths which are mounted to a common shaft that runs parallel to the camshaft. On a manufactured engine, this is accomplished according to the following steps (351 Cleveland Engine manufactured by Ford as a base): 1) removal of the factory installed rocker arm configuration from each cylinder head, including the mounting studs, 2) machining of the cylinder head to a flat plane preferably to the lowest planar surface, 3) machining push rod aperture holes increasing the vertical angle of each push rod stance by approximately five degrees; 4) securing a bridge base of the instant invention onto the machined surface, the bridge base secured to the cylinder head by use of twelve point bolts utilizing the threaded holes of the removed studs; 5) positioning a shaft across at least a section of said bridge base, 6) coupling a compound rocker arm to said shaft, said rocker arm sized to rotate about the shaft having one end contacting a valve stem and a second end contacting a push rod, 7) attaching a bridge top to said bridge base by bolting said bridge top directly to the cylinder head securing said rocker arm shaft therebetween, 8) checking the height of each valve stem in accordance with an adjacent valve so as to allow for stem tolerance adjustment.

The apparatus of the instant invention is a rocker arm bridge support which incorporates a base bridge securable to a cylinder head having compound geometry raised facie removed, alternatively the lower surface of the bridge base is machined to accommodate the raised facie. The bridge base is bolted directly to the cylinder head and allows for support of a floating shaft by coupling the shaft between the bridge base and a bridge top operatively associated with the bridge base and bolted directly to the cylinder head through bridge base apertures. The free floating shaft is maintained in a parallel plane to the camshaft and allows the use of offset rocker arms of varying length so as to accommodate the offset geometry of the valve stems and associated push rods.

In this manner, the compound geometry valve train is eliminated and replaced with a rigid bridge structure wherein the complex angles are accommodated by use of offset rocker arms. The shaft used for support of the rocker arms may be single piece or segmented to lower cost of manufacturing. Shaft rotation is prevented by chamfering the ends of the shaft and positioning the shaft adjacent to bridge base aperture wherein the bridge mounting bolts engage the chamfered ends of the shaft. It should be noted that the segmented shaft would allow for a segmented bridge although preferred embodiment is a solid bridge with segmented shafts providing optimum rigidity yet maintaining a low cost of manufacture. A further embodiment of the instant invention is the use of a shaft mounted-stand assembly for the rocker arms which provides increased rigidity to its mounting base by leverage from above the pivoting point of the rocker arms through a bridged super structure that ties two or more rocker arm assemblies together. The bridge may include radiating fins for cooling purposes.

Thus, an objective of the instant invention is to provide a method and apparatus for removal of the compound geometry cylinder heads used on commercial and high performance engines for the reduction of valve train flex eliminating wasted energy resulting from valve train flexing.

Another objective of the instant invention is to provide a mechanism that eliminates the need for bolting of the rocker arm shaft to the cylinder head by use of a free-floating shaft secured to a bridge assembly which is directly coupled to the cylinder head. Still another objective of the instant invention is to reduce or eliminate rocker arm movement by elimination of the compound rocker arm geometry and using a single bridge having a common base and securing member for rigid mounting of the rocker arm assembly.

Yet still another objective of the instant invention is a consolidation of a rocker arm assembly which removes the independent loads to the rocker arm of each valve through mounting by a common and shared design which will unify and disperse loads with increased leverage of resistance.

Yet still another objective of the instant invention is to provide support through mass and leverage of any mounting device by instilling rigidity to the cylinder head which will improve the overall rigidity of the valve train attached to the support simplifying the accuracy of the rocker arm operation in relation to the valve and provide for a mounting system that can unify the rocker arm mounting providing a rigid assembly.

Yet still another objective of the instant invention is to provide a rocker arm design which allows cylinder head design by use of a unified assembly which is mounted parallel to the axis of the camshaft and will simplify the radial motion of the rocker arm with the linear motion of the valve providing increased rigidity to the overall system with optional provision to dissipate heat.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
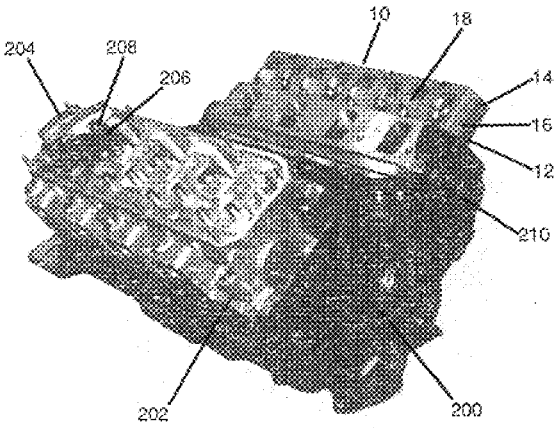
FIG. 1 is a pictorial of a cylinder block for a V-8 engine having one cylinder head depicting the prior art and a second opposing cylinder head depicting the instant invention.

Now referring to FIG. 1, set forth is a pictorial view of a cylinder block 200 having a first cylinder head 202 with the known prior art high performance valve arrangement 204 utilizing support blocks 206 which are mounted to the cylinder head 202 with individual shafts 208 which secure the rocking arm 210 through the use of mounting bolts placed through apertures in each of the shafts. Shown on cylinder head 210 is the instant invention 10 mounted on the cylinder head consisting of a bridge base forming a lower portion 12 and a bridge top forming an upper portion 14 with a centrally disposed shaft 16 having a diameter of approximately 0.870 inches, the shaft allowing for the articulation of offset rocker arms 18.

Figure 2:
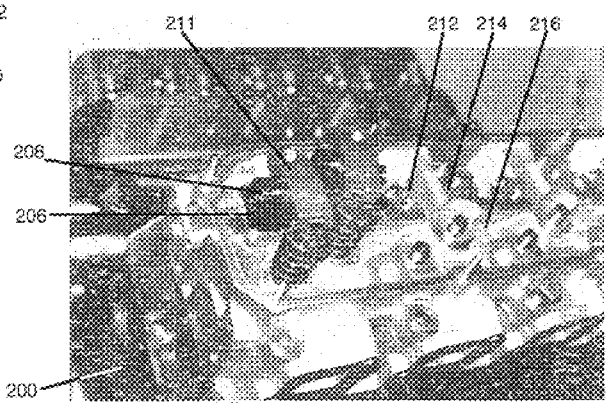
FIG. 2 is a pictorial view of the prior art.

Referring to FIG. 2, shown is an enlarged pictorial view of the prior art shown on bank one of the engine block 200 illustrated in FIG. 1. The rocker arms 211 are secured to the cylinder head 202 by use of individual rocker arm shafts 208 to the support block 206 which is mounted on the compound geometry raised facia 212. The raised facia is further illustrated by reference numeral 214 where no rocker arm is located.

Figure 3:
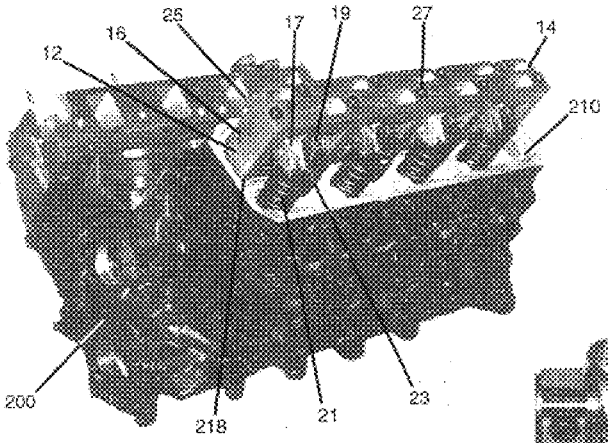
FIG. 3 is a pictorial view depicting the instant invention installed upon a cylinder head.

FIG. 3 sets forth an alternative view of FIG. 1 with engine block 200 supporting the second cylinder head 210 with bridge base 12 bolted to the cylinder head 210 after the raised facia, as shown on FIG. 2 (reference numerals 212 and 214), have been removed by machining of the surface to a common flat planar surface 218. Once the bridge base 12 is bolted to the cylinder head 210, shaft 16 is placed within a shaft holding area wherein the shaft may be made of segmented pieces or a single common shaft. The shaft supports rocker arms depicted by numerals 17 and 19 which are more fully described later in this description. Rocker arms are used to depress valve springs 21 and 23 which are secured to a representative intake and exhaust valve in the ordinary and conventional manner. The opposite end of the rocker arm is coupled to a push rod which is operated by the camshaft allowing the rocker arm to rotate along the shaft 16 so as to depress the valve in accordance with a particular camshaft lobe. The bridge top 14 is coupled directly to the cylinder head 210 by use of mounting bolts 27 which pass through the bridge base 12 by use of enlarged apertures for threading directly to the cylinder head. The result is a free floating shaft that is secured between the bridge base and bridge top which are further secured to the cylinder head and do not rely upon each other for coupling purposes.

Figure 4:
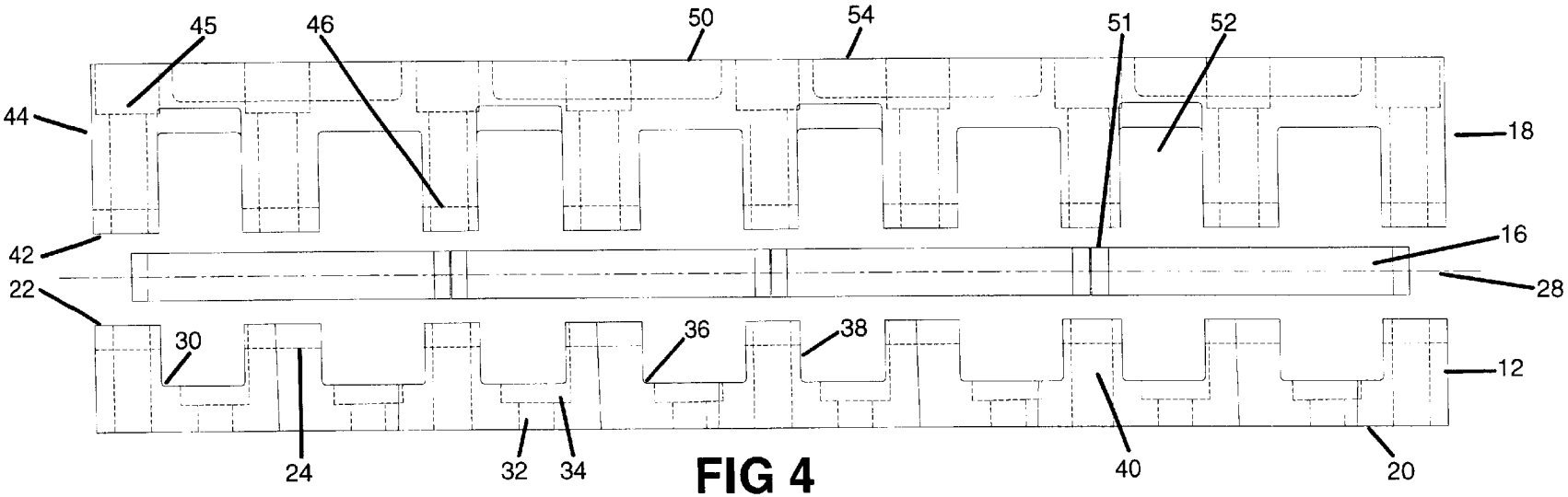
FIG. 4 is a cross sectional side view of the bridge base, bridge top, and segmented shafts.

Now referring to FIG. 4, set forth is an exploded view of the instant invention consisting of the two-piece bridge 3 structure having a bridge base 12 constructed of a 4 substantially rectangular member having a flat bottom surface planed for placement against a planned surface of a cylinder head. The bridge base 12 includes a top surface 22 having a centrally disposed slot 24 depicted by the hidden lines which extend along the length of the bridge base. The slot 24 is receptive to a shaft 16 encompassing one half of the diameter of the shaft as depicted by center line 28. The bridge base includes cutout sections 30 which provides clearance for offset designed rocker arm articulation. At the bottom of each cutout section is a through hole 32 having a recessed head bolt area 34 which allows placement of a mounting bolt to secure the bridge base to the cylinder head. The recessed head bolt area 34 allows for the securement of the bridge base maintaining an uninhibited cutout section 30 by placement of the bolt head beneath surface 36. The cutout section and upper surface 22 is spaced apart by upstanding support members 38 each having aperture 40 providing a through hole aperture from the upper surface 22 to the lower surface 20. It should be noted that in place of squaring off the bridge base by machining of the cylinder head, the bridge base may be matched to the cylinder head by the inclusion of angles which closely duplicate the cylinder head. This modification limits the application of the bridge base to a particular engine type but is deemed within the scope of this invention as the modification of the cylinder head versus the bridge base 3 would be obvious to one of ordinary skill in the art.

During installation, a conventional rocker arm system is removed including the mounting studs which form the basis for a compound geometry cylinder head wherein the upper surface of the cylinder head is machined into a flat planar surface preferably at the level of the lowest planar surface set forth on the compound geometry cylinder head. Once the surface is planed the bridge base 12 is placed over the machined surface and secured thereto by placement of mounting bolts through aperture 32 wherein the head of the bolt fits within recess 34 so as to maintain the cutout section 30 special area preventing interference with rocker arm operation. The shaft 16 can be made of a single piece of steel or as illustrated for a V-8 engine having four cylinders on one side of the block the embodiment allows for the shaft to be constructed of four individual segmented pieces juxtapositioned along each end allowing for a reduction in manufacturing costs without changing actual operation characteristics. It is noted that the preferred methodology is to include at least two rocker arms on a single shaft for optimum stability.

The cutout sections 30 are further sized to accommodate the offset rocker arm to be employed with the shaft having alternating chamber widths dependent upon valve placement and the angular direction of the rocker arm. In the preferred embodiment the width in the chamber is between one and one and a half inches. The depth of the chamber is approximately one inch with the height of the lower portion at approximately 1.4 inches. As will be described later in this specification, the invention utilizes offset rocker arms in place of offset surface heads to accommodate the valve arrangement.

The bridge top 18 is defined as a substantially rectangular member having a length with a bottom surface 42 formed along leg stands 44 for placement against the upper surface 22 of the lower portion 12. The bottom surface 42 includes a centrally disposed slot 46 extending along the length of the member receptive to the shaft 16 wherein half of the shaft, depicted by center line 28, is positionable within the slot 46. In this manner, shaft is placed within slot 24 and 42 allowing the bridge top 18 to be placed against the bridge base 12 upon the positioning of upper surface 22 and lower surface 42 of the respective portions. The engagement securely positions the shaft 16 within the bridge framework which is further supported by at least three support members encompassing at least two cutout sections 30 providing support for at least two rocker arms. The segmented shaft is shown with split lines 51 with a bevel leading to each split section. The bridge top 18 includes cutout chambers 52 which, in a similar fashion to the bridge base, are sized to accommodate valve arrangement in light of the angular design of the particular offset rocker arm. The bridge top also includes countersunk section 54 which allows placement of the bolt head beneath the upper surface 50 maintaining a low clearance for placement beneath the cylinder head valve cover with aperture 48 operatively associated with aperture 22.

Figure 5:
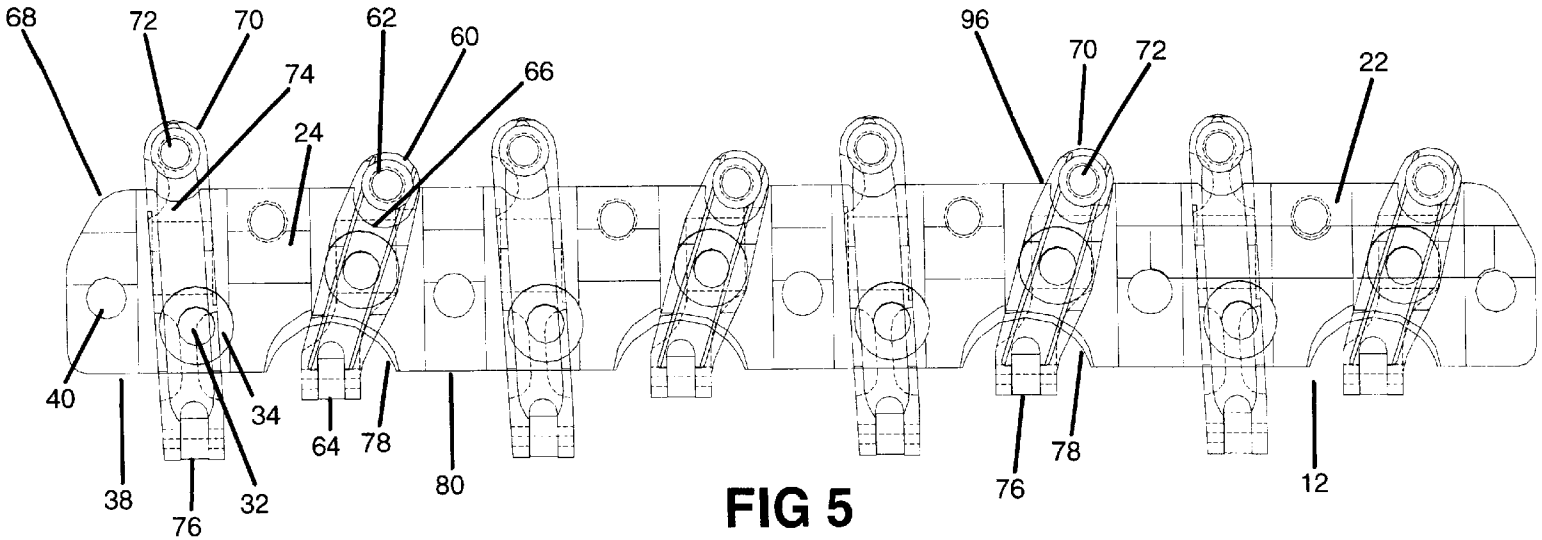
FIG. 5 is a top view of the bridge base including offset rocker arms placed in position for securement by the segmented shaft.

Now referring to FIG. 5, set forth is a top view of the bridge base 12 with the bridge top 18 removed for clarity. The bridge base 12 having upper surface 22 with slot 24 illustrated across each upstanding support member 38. As shown by way of illustration, the upstanding support members have apertures 40 placed through each upstanding support member 38 and, as provided by way of illustration, alternate on each side of slot 24 along the length of the structure. In this manner, a shaft that encompasses two rocker arms is supported in a minimal three point stance from the compressed fit of the bridge top. As previously noted, the bridge base 12 is directly secured to the cylinder head by placement of a bolt, now shown, through aperture 32 having countersunk head 34.

The shaft, not shown, fits within slot 24 to support the rocker arms in a centrally disposed manner as shown by intake rocker arm 60 having a first end 62 receptive to a push rod and a second roller tip end 64 for use in depressing the intake valve for allowing gases to enter the cylinder chamber. Side section 66 of wall 68 is removed allowing a full range of push rod movement. The rocker arms facilitate mounting upon a common shaft. The offset design allows for staggered valve or canted valve cylinder head designs providing a unified assembly mounted parallel to the axis of the camshaft and providing radial motion with the linear motion of the valve.

The exhaust rocker arm 70 utilizes end 72 to engage a push rod with side section 74 formed inward from side wall 68 so as to provide clearance for a push rod. A second end of the rocker arm 70 includes roller 76 attached thereto for depression of the exhaust valve.

Figure 6:
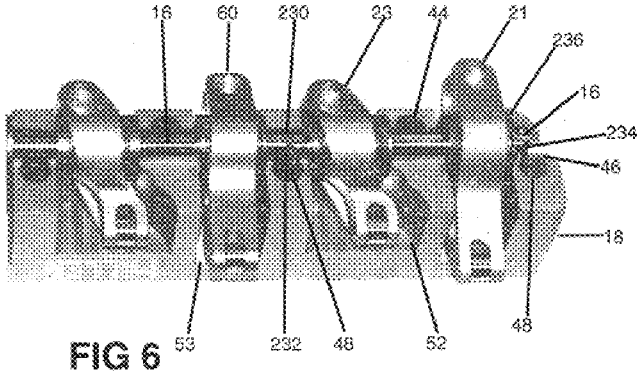
FIG. 6 is a pictorial view of the bridge base including the offset rocker arms and segmented shaft.

Now referring to FIG. 6, shown is a partial top pictorial view of the bridge top 18 having shaft 16 placed within slot 46. The shaft depicted is segmented showing split line 230 having beveled ends 232 which allow placement of a bolt in aperture 48 for maintaining of the shaft in a fixed position. Similarly, an opposite end of segmented shaft 16 includes beveled end 234 which allows shaft positioning upon placement of a bolt in aperture 48'. Rocker arms 21 and 23 are shown attached to the shaft 16 with spacer roller bearings 236 placed along each side of the rocker arm for maintaining proper positioning between upright members 44. Cutout chamber 52 is illustrated having an enlarged area for the offset allowing the rocker arm itself to accomplish the offset angular positioning as opposed to rotation of a straight line rocker arm depicted by the prior art. Similarly, cutout 53 allows for the offset of rocker arm 60 which is set off only a few degrees as further described in this invention for clearance.

Figure 8:
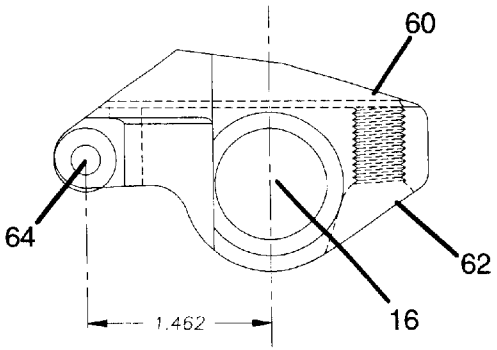
FIG. 8 is a side view of an intake valve offset rocker arm.
Figure 9:
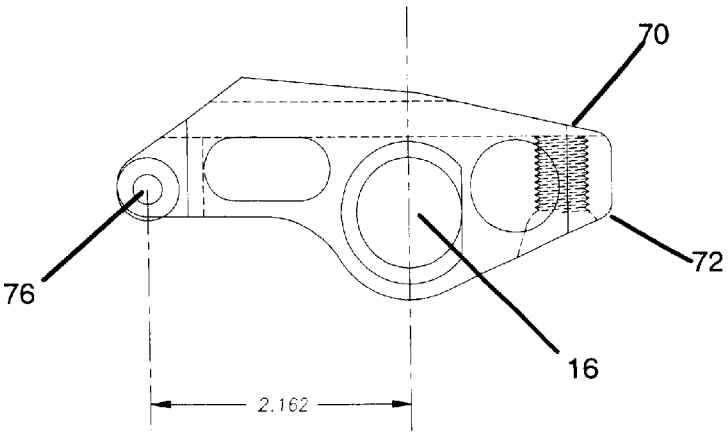
FIG. 9 is a side view of an exhaust rocker arm.
Figure 7:
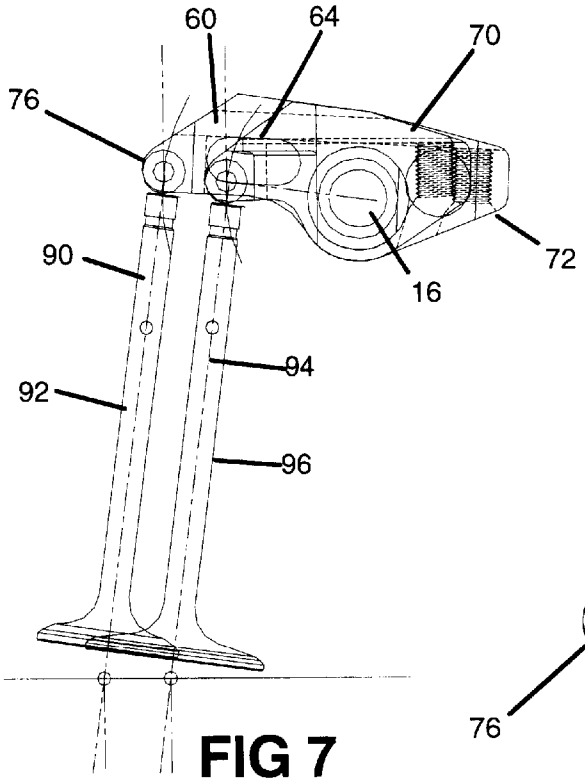
FIG. 7 is a pictorial view of an intake and exhaust valve placed in position for operation by the rocker arm.

Now referring to FIGS. 7–9, valve rocker arm 70 includes roller tip 76 for engaging the stem 90 of exhaust valve 92. The shaft 16 provides a pivot point for rocker arm 70 between push rod end point 72 and roller tip 76. Similarly, intake rocker 60 has the roller tip 64 for engagement of stem 94 of intake valve 96. The shaft 16 provides a pivot point for the intake rocker arm 60. The embodiment allows for the use of a common shaft with staggered length rocker arms allowing the use of the rocker arm to accommodate the compound geometry angles employed by the engine manufacturers which result in the placement of the intake and exhaust valves at various locations and angles as well as positioning of a push rod for operation in conjunction with the camshaft. In this manner, a novel rocker arm assembly is created which attaches two or more rocker arms per shaft in such a way that a perpendicular relationship can be accurately maintained with the valve throughout the valve lifting operation. This maintains the use of a common shaft which is parallel to the camshaft and is specific to the cylinder heads having staggered valves that otherwise would have required independent rocker arm mounting, either due to compound angle rocker arm alignment with the valve, which may or may not be a compound angle, or due to staggered offsets of the separate intake and exhaust valves contained for each cylinder. Thus, by maintaining a common shaft in a parallel plane to the camshaft the rocker arm accommodates the offset angle both in length and angular offset so as to accomplish the necessary operation.

FIG. 8 depicts the intake rocker arm 60 having the shaft 16 operating as a pivot point between the push rod section 62 and roller tip stem engaging section 64. The angular offset of the rocker arm is further illustrated by reference to FIG. 5. The intake valve is depicted in FIG. 7 with shaft 16 operating as a pivot point between push rod section 72 and roller tip end 76 which engages the intake valve stem.

Figure 10:
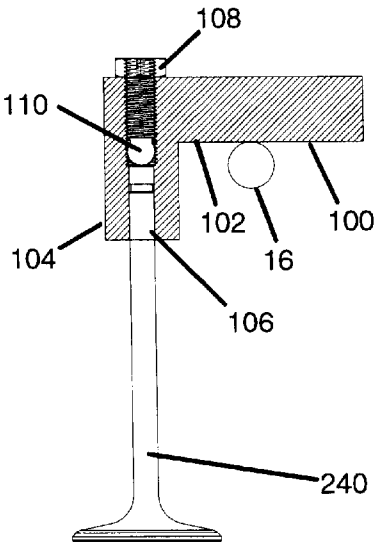
FIG. 10 is a side view of an alignment device for positioning of each valve stem to the bridge.

Referring to FIG. 10, proper shaft alignment is made possible by the geometry tool 100 which is an L-shaped, structure having a lower planed surface 102 positionable over shaft 16 with end portion 104 having aperture 106 available for insertion of valve stem 240. On one end of the aperture is an adjustment bolt 108 having a threaded shaft which engages a threaded portion of aperture 106. Engagement head 110 is adjusted for placement of valve stem 240 in a predefined position. If the tolerances of the stem are unacceptable, the stem may be ground down thus accommodating for excessive material removal from the cylinder head during the retrofitting step.

Figure 11:
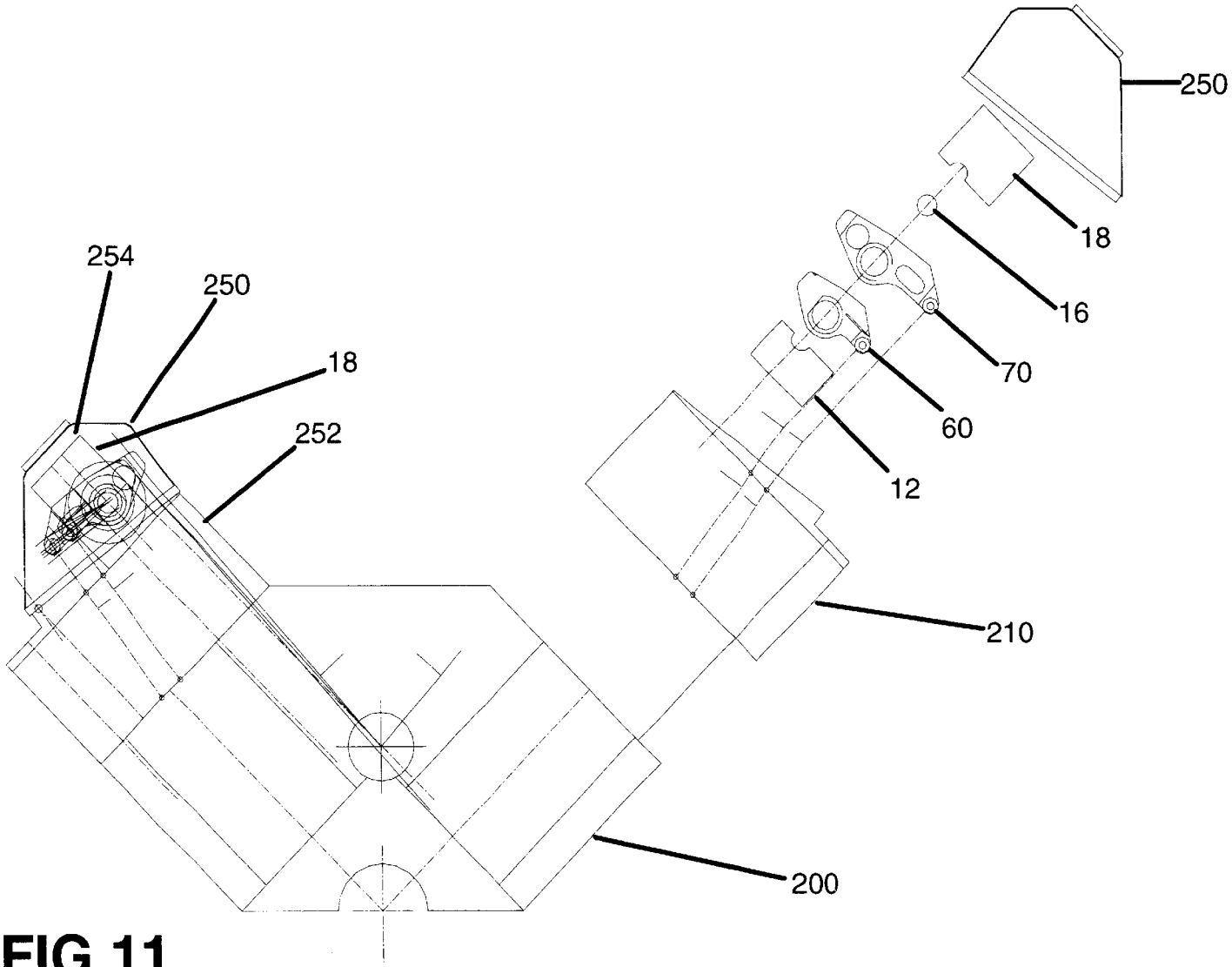
FIG. 11 sets forth a pictorial of an engine block having a cylinder head with the instant invention installed and a second cylinder head set forth in an exploded view depicting the valve arrangement and cover without the mounting hardware.

Now referring to FIG. 11, set forth is an exploded view of the apparatus with engine block 200 separated from the cylinder head 210 with bridge base 12 aligned for shaft 16 and bridge top 18. Rocker arm 60 and 70 are readied for placement around shaft 16 for securement between bridge base 12 and bridge top 18. Valve cover 250 maintains oil lubrication within the enclosed area. At this time it is again noted that bridge base 12 and bridge top 18 provide ancillary functions and may be modified to accommodate such functions such as cylinder head cooling by construction of fins along the bridge structure which would allow radiant heat dissipation. In addition, the bridge structure allows a support member for various devices placed within the confines of the valve train including monitoring sensors and alternating valve depressors. Cylinder head 252 depicts valve cover 250' in a secure position over bridge top 18' illustrating clearance as depicted by numeral 254 provided for the bridge device.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A method for eliminating a compound geometry in a valve train of an internal combustion engine; wherein said engine has a cylinder head with an upper surface, a camshaft that pushes a plurality of push rods that are each extended through a respective push rod mounting aperture in said cylinder, and a valve train assembly operated by said camshaft containing a plurality of rocker arms that are each pushed by one of said push rods wherein said valve train assembly is attached to said upper surface by a plurality of mounting bolts that insert into complementary valve train bolt holes in said upper surface and wherein said rocker arms pivot about their own respective stud that is inserted in a threaded aperture in said upper surface; said method comprising the steps of:

a) unbolting said mounting bolts from said valve train bolt holes and removing the existing valve train assembly from said upper surface;

b) extracting said studs from said threaded apertures, c) machining the upper surface to remove said compound geometry surfaces providing a flat planar surface;

d) positioning a bridge base having a first shaft receptacle onto said flat planar surface of said cylinder head so that said shaft receptacle is parallel to said camshaft;

e) securing said bridge base to said cylinder head with at least two mounting bolts that each threadingly engage one of said threaded apertures;

f) inserting a shaft having a length and a diameter into said shaft receptacle of said bridge base, so that said shaft is parallel to said camshaft;

g) sliding at least two compound angle rocker arms over said shaft, one of said rocker arms sized to operate in conjunction with a valve stem and a push rod for an offset exhaust valve and another of said rocker arms sized to operate in conjunction with a valve stem and a push rod for am offset intake valve;

h) positioning a bridge top over said bridge base, said bridge top having a second shaft receptacle operatively associated with said shaft receptacle of said bridge base; and i) securing said bridge top to said cylinder head with at least three mounting bolts that threadingly engage said mounting holes.

2. The method according to claim 1 wherein step c) is further defined as machining said upper surface to a level in which any raised compound geometry mounting facia is eliminated.

3. The method according to claim 1 wherein step c) includes the step of boring said push rod mounting aperture to increase a vertical stance of each aperture.

4. The method according to claim 3, wherein said vertical stance is increased by approximately five degrees.

5. The method and apparatus according to claim 1 wherein step g) includes the step of aligning said intake and exhaust stems to said shaft.

6. The method and apparatus according to claim 5 wherein said step of aligning includes the use of an aligning block defined by an L-shaped block having a horizontal portion for placement over said shaft and a vertical portion having an aperture positioned perpendicular to said horizontal portion with a first end of said aperture sized to accommodate the stem tip of an exhaust or intake valve and a second end having a threaded aperture for positioning of a thread adjustment bolt.

7. A method for eliminating a compound geometry in a valve train of an internal combustion engine; wherein said engine has a cylinder head with an upper surface, a camshaft that pushes a plurality of push rods that are each extended through a respective push rod mounting aperture in said cylinder, and a valve train assembly operated by said camshaft containing a plurality of rocker arms that are each pushed by one of said push rods wherein said valve train assembly is attached to said upper surface by a plurality of mounting bolts that insert into complementary valve train bolt holes in said upper surface and wherein said rocker arms pivot on their own respective stud that is inserted in a threaded aperture in said upper surface; said method comprising the steps of:

a) unbolting said mounting bolts from said valve train bolt holes and removing the existing valve train assembly from said upper surface;

b) extracting said studs from said threaded apertures, c) machining the upper surface to remove said compound geometry surfaces and to create a flat planar surf ace with no raised compound geometry mounting facia;

d) boring said push rod mounting aperture to increase a vertical stance of each apertures;

e) positioning a bridge base having a first shaft receptacle onto said flat planar surface of said cylinder head so that said shaft receptacle is parallel to said camshaft;

f) securing said bridge base to said cylinder head with at least two mounting bolts that each threadingly engage one of said threaded apertures;

g) inserting a shaft having a length and a diameter into said shaft receptacle of said bridge base, so that said shaft is parallel to said camshaft;

h) sliding at least two compound angle rocker arms over said shaft, one of said rocker arms sized to operate in conjunction with a valve stem and a push rod for an offset exhaust valve and another of said rocker arms sized to operate in conjunction with a valve stem and a push rod for an offset intake valve;

i) aligning said intake and exhaust stems to said shaft;

j) positioning a bridge top over said bridge base, said bridge top having a second shaft receptacle operatively associated with said shaft receptacle of said bridge base; and k) securing said bridge top to said cylinder head with at least three mounting bolts that threadingly engage said mounting holes.

* * * * *